United States Patent [19]

Rademakers

[11] Patent Number: 4,498,877

[45] Date of Patent: Feb. 12, 1985

[54] ANCHORING SYSTEM FOR A BUOY, SPECIALLY A MEASURING BUOY

[75] Inventor: Petrus J. Rademakers, Aerdenhout, Netherlands

[73] Assignee: Datawell B.V., Netherlands

[21] Appl. No.: 338,625

[22] Filed: Jan. 11, 1982

[30] Foreign Application Priority Data

Jan. 15, 1981 [NL] Netherlands ..... 8100165

[51] Int. Cl.[3] ..... B63B 21/52

[52] U.S. Cl. ..... 441/23; 441/21

[58] Field of Search ..... 441/21, 23, 24, 25, 441/133; 244/33; 114/264, 265

[56] References Cited

U.S. PATENT DOCUMENTS 1,115,363 10/1914 Wood ..... 441/21
3,256,539 6/1966 Clark ..... 441/21
3,276,049 10/1966 Stixrud ..... 441/21
3,543,526 12/1970 O'Neil et al. ..... 441/21
3,728,748 4/1973 Roehler ..... 441/23
4,383,831 5/1983 Cupolo et al. ..... 441/22

FOREIGN PATENT DOCUMENTS 382726 11/1932 United Kingdom ..... 441/3

*Primary Examiner*—Trygve M. Blix
*Assistant Examiner*—Rodney Corl
*Attorney, Agent, or Firm*—Larson and Taylor

[57] ABSTRACT

An anchoring system for buoys and specially measuring buoys in which an anchoring line is connected to an anchoring line connection member which is connected by at least two connection links to the buoy. The connection links have equal length and the connection points q of the links with the anchoring line connection member have a configuration that is congruent to the configuration of the points p, where the links are connected to the buoy.

8 Claims, 2 Drawing Figures

ANCHORING SYSTEM FOR A BUOY, SPECIALLY A MEASURING BUOY

Figure 1:
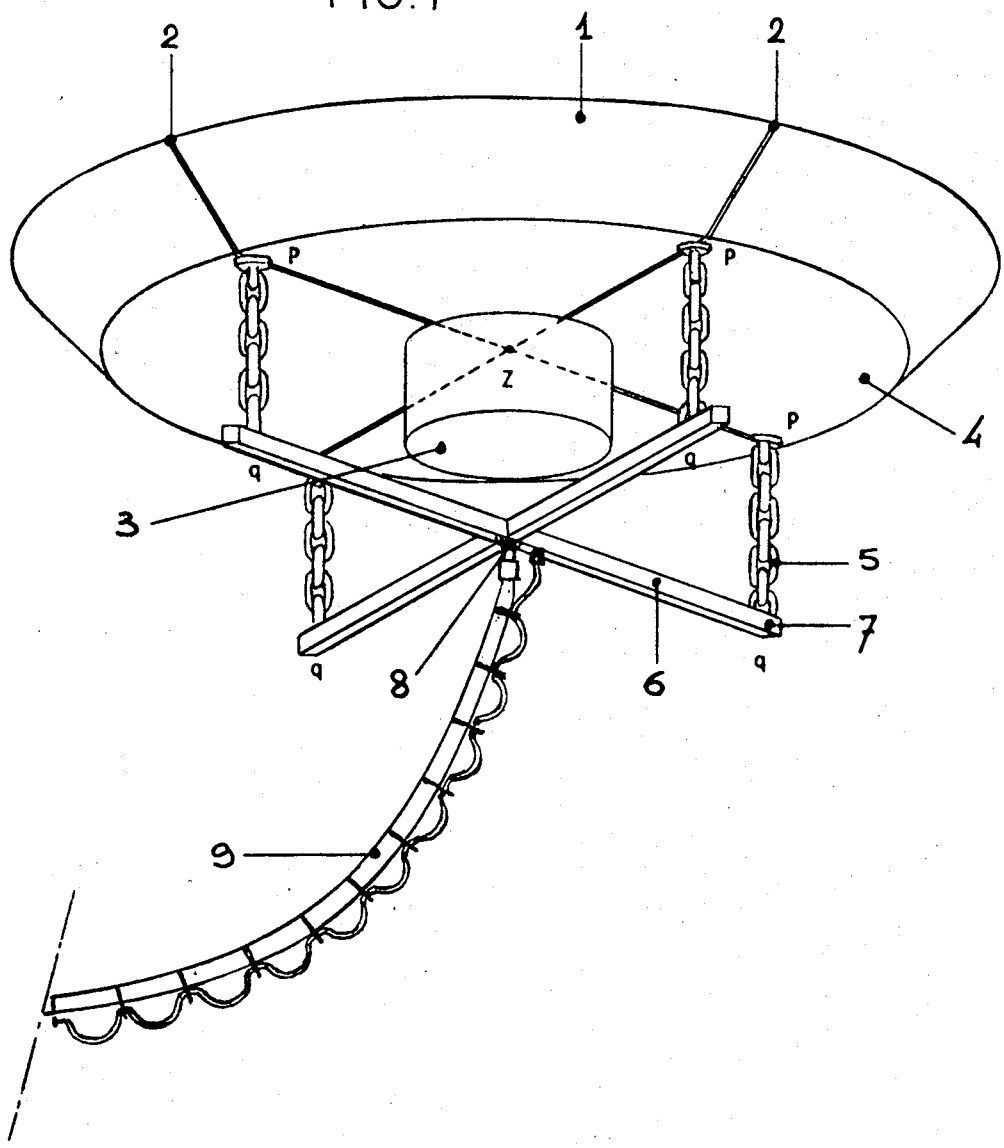

The invention relates to a system for connecting a buoy to an anchoring line.

Many systems serving the indicated purpose are known, but in certain cases only solutions exist that have disadvantages. This holds specially but not exclusively for measuring buoys, for instance buoys bearing instruments for detecting and measuring water movements.

More specifically difficulties may occur with measuring buoys which have to follow the movements of the water. With buoys that measure the movements of the water surface tilting of the buoy by the force that the anchoring line exerts on it, will influence the measuring results. In that instance one can try for such a connection of the anchor line to the buoy that the work point of the force exerted by the anchor line on the buoy corresponds to the work point of the horizontal reaction force caused by a horizontal water velocity with respect to the buoy.

Such an anchoring system has been described in the Dutch Patent Specification No. 152,211 to Datawell B. V.

This known system has, however, the disadvantage that it is necessary that the members for connecting the anchoring line are located in the central part of the buoy.

Further, a system for anchoring a mooring buoy to an underwater oil pipe line is described in the French Patent Specification No. 2,061.092 to Esso Research and Engineering Company, in which mutually parallel lines of equal length are connected between a member connected to a fixed point of the sea bottom and a mooring buoy. Except for a line that leads to the centre of the bottom of the buoy, these lines are not intended to transmit the anchoring force. They are connected to the bottom of the buoy, so that, even if they would be operative as anchoring means, they would not prevent the bouy from tilting in response to water currents.

The invention aims to provide a system overcoming the above indicated difficulties and allowing the centre of the buoy to be kept free from anchoring means.

Accordingly the invention provides a system, in which said connection members are anchoring links for the buoy and are located outside the center of the buoy and outside the center of the anchoring line connection member. The connection points between the said anchoring links and the buoy have mutually the same position in space as have the connection points q between the said anchoring links and the anchoring line connection member, the said anchoring links and their connections to the buoy and the anchoring line connection member being such that the anchoring links are free to extend in all relevant directions.

The advantage of the invention, namely that at the point of impact of the forces exerted by the anchoring line, this line need not be physically present, allows also in other cases important improvements. For instance with measuring buoys that have to follow the water surface it is of great importance that the buoy will not be tilted by the reaction force of the anchoring line. Further, such buoys normally have considerable horizontal dimensions in order to better follow the wave slope and only a very small draught, as that with such buoys a connection to the centre gives rise to very serious problems with respect to locating instruments and the like.

A further condition that preferably has to be fulfilled by such buoys is, that the centre of gravity of the buoy with its contents and the point of impact of the anchoring line have to coincide.

According to the invention this goal can be realized in providing that the point at which the anchoring line is connected to the anchoring line connection member corresponds to the centre of gravity Z of the buoy.

Further in many cases it is important that the point of impact of the anchoring line forces coincide with the centre of gravity of the water displaced by the buoy.

Accordingly a preferred embodiment of the invention provides that the point at which the anchoring line is connected to the anchoring line connection member corresponds to the centre of gravity Z of the water displaced by the buoy.

Also a combination of both mentioned embodiments, namely having the centres of gravity of the buoy and of the water displaced by it coincide to the point of impact of the anchoring line forces improves the equality of the angular movements that the water surface would have made if the buoy was not present and of the angular movements of the buoy.

If the anchoring line force is applied to this common centre of gravity one has minimum disturbances of the buoy's movements by reason of the anchoring line forces.

When the connection links have only to transmit tensile forces they are preferably flexible such as chains or lines. Rigid connection links ought to be mounted to the buoy and the anchoring line connection member pivotably in all directions.

In the following the invention is described with reference to of the drawing, in which FIG. 1 shows a perspective view of an embodiment of the invention; and FIG. 2 serves to illustrate the basic principle of the invention.

Figure 2:
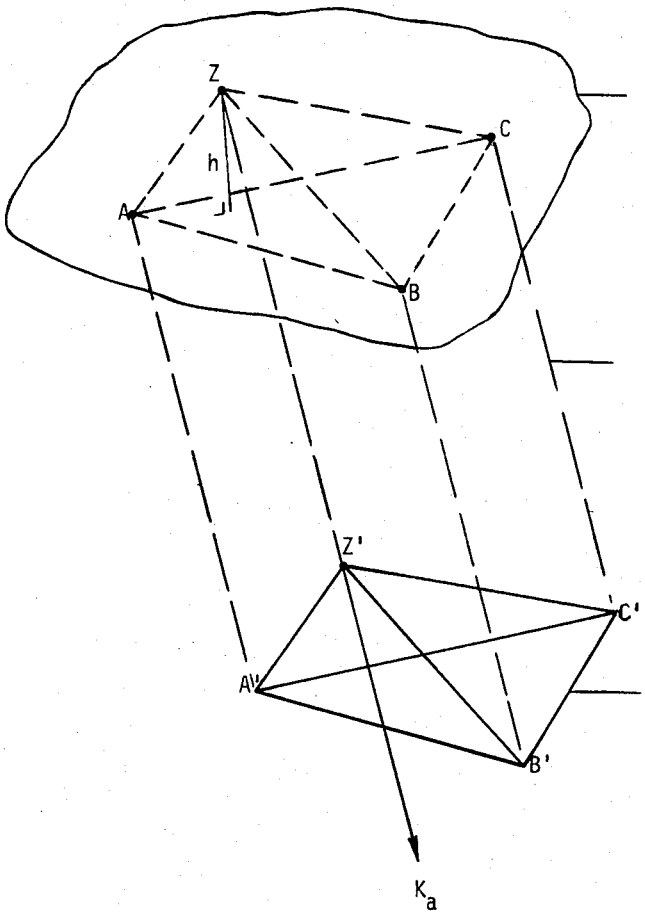

In FIG. 2 an example has been shown with connection points A, B and C on a buoy. Z is the point within the buoy at which one wants to apply the anchoring line force Ka. Z need not be located in a plane through A, B and C. In fact, in FIG. 2, Z is located a distance h above this plane.

The framework defined by lines A', B', C' and Z' is the anchoring line connection member. The connection lines are AA', BB' and CC'. Because ΔABC is congruent with ΔA'B'C' and AA'=BB'=CC' the connection lines AA', BB' and CC' are mutually parallel.

Suppose the anchoring line is connected at Z'. If the weight of the anchoring line connection member cannot be neglected care should be taken that its centre of gravity coincides with the point of application of the anchoring line force. It then holds that all forces, anchoring line force and forces generated by gravity, apply at Z'. Consequently $K_a$ is the resultant of the anchoring line force and gravity.

Because the connection points A, B, C, A', B' and C' are pivotable in all directions and the connection links AA', BB' and CC' are parallel, the directions of these connection links will be parallel to that of the force $K_a$. The triangle A'B'C' can then be considered to be a translated triangle ABC with a translation distance equal to the length of a connection link and a translation direction qual to that of the force $K_a$.

If one now chooses Z' such that it coincides with Z after it has been subjected to the same translation then, because the translation direction always remains the same as the direction of $K_a$, the line of $K_a$ will always pass through Z, so that the rotary momentum of $K_a$ with respect to Z always remains zero which means that $K_a$ always applies at Z.

If in other words the pyramid formed by the buoy connection points A, B and C and the point Z is congruent with the pyramid formed by the connection points A', B' and C' of the anchoring line connection member and the point of application Z' and all connection links have equal length, then $K_a$ will always apply at Z. If more connection links are used the same will hold true as long as congruence of the points configurations in buoy and anchoring line connection member is present and the links have equal lengths. The connection points in the buoy need not be located in one plane.

When using only two connection points A and B in the buoy and A' and B' in the anchoring line connection member, the further condition must be fulfilled that Z and Z' are located on the lines AB and A'B', respectively.

With more than three connection links theoretically a static overdetermined problem results. Because, however, in practice buoys, specially if they are of modern construction, i.e. of plastic foam, have sufficient flexibility, this static overdetermination is eliminated. For the remainder this static overdetermination does not play any part when determining the point at which the force exerted by the anchoring line applies on the buoy.

The condition that the connection links should have equal length is based on the fact that, if this is not the case, and the anchoring line connection member takes another position with respect to the buoy, the direction of the force exerted by the anchoring line changes, and the angles between the connection links and a fixed reference direction in the buoy change in different ways, by reason of which the point in which the anchoring line exerts its force on the buoy can shift.

Though the invention may have many applications and executions a simple embodiment exists if the buoy connection points are located in one plane.

In practice buoys often have a vertical symmetry axis. In that instance a simple embodiment of the invention exists if connection points between the anchoring links and the buoy are located on a circle having its centre on the said axis. Herewith a regular distribution of forces is obtained if according to a further elaboration of the invention it is provided that the said connection points are the angular points of a regular polygon or the ends of a straight line.

In the case of four buoy connection points a simple embodiment of the invention exists in that the polygon is a square and the anchor line connection member a cross having equal arms, and the anchoring line is connected to the centre of the cross. The use of more than two buoy connection points, consequently more than theoretically necessary has the important advantage that the anchoring forces which the buoy has to stand are better distributed over the buoy.

With a measuring buoy the float body of which for an important part consists of four circle segments, it provides mechanical advantages to use also four buoy connection points. When using four buoy connection points and an equal armed cross it is not necessary that the cross is completely rigid. To obtain the effects of the invention it is only necessary that the cross has two rigid beams which are non rigidly connected with each other.

In that case the anchoring line is for instance connected to the centre of a first beam, which at its ends is connected to two connection links of equal length. Further, the centre of this first beam is connected to the centre of a second beam, which at its ends also is connected to two connection links of mutual equal length. The length of the connections from the first beam to the buoy has to be always the same, which means that the length of the links connecting the first beam to the buoy equals the sum of the lengths of the connections between the centres of both beams and that of the connection links between the second beam and the buoy. In fact the length of the connection members between the first beam and the buoy is always the same, but in one instance it consists of a single connection link and in the other instance is composed of the connection between the two beams and the link between the second beam and the buoy. This case also illustrates the fact that the invention can be applied in duplicate between one anchoring line and one buoy.

An application of the invention which provides a simple, yet effective construction and which allows for an important simplification of the total configuration for a buoy having a plane partial bottom surface in which the centres of gravity of the buoy and of the water displaced by the buoy are located consists in that the connection links are connected to said partial bottom surface. Such a buoy is very well suited for measuring wave slopes.

In FIG. 1 a buoy has been shown with a rigid cross shaped anchoring line connection member 6, provided with a disc shaped body 1 consisting of four segments connected to each other at the joints 2, and protrusion 3 being applied at the lower side. This buoy is such, that the point Z in the plane of the lower surface of the disc 1 but inside the protrusion 3 is the centre of gravity of the buoy and of the water displaced by the buoy.

At the said lower surface, which in fact is a partial bottom surface, are in the points p of the connection links 5, shown as chains, connected to the joints 2, which links at the points q, one of which is indicated with reference 7, are connected to the other member 6 having two perpendicular arms of equal length. To the centre of said cross or the cross-over point of the beams an anchoring line attachment member 8 is mounted, to which the anchoring line 9 is connected.

What I claim is:

1. An anchoring system for a buoy, said buoy being adapted to follow the wave slopes of a water surface in which it floats, having an anchoring line connection member connected to an anchoring line at an anchoring line attachment point, at least two non-extensible and parallel links connecting said anchoring line connection member to said buoy, said links having equal length from their point of attachment to said anchoring line connection member to their point of attachment to said buoy, the mutual configuration in space of (a) said points of attachment to said anchoring line connection member and (b) said points of attachment to said buoy, being identical, and wherein the point of impact of the anchoring line force, taken with respect to the points of attachment of the links to the buoy, is fixed and located in the same position as is the anchoring line attachment point, taken with respect to the points of attachment of the links to the anchoring line connection member, said point of impact of the anchoring line force being located inside a body part of said buoy, said anchoring line and said links being connected to said anchoring line connection member and said buoy such that said line and said links are free to extend from said anchoring line connection member and said buoy in all directions having an vertical component.

2. An anchoring system for a buoy as claimed in claim 1 wherein the buoy is disc shaped, and wherein the length of each of said links is less than the diameter of the buoy.

3. An anchoring system for a buoy, said buoy being adapted to follow the wave slope of a water surface in which it floats and which is equipped to detect and measure its own orientation with respect to the vertical, having an anchoring line connection member connected to an anchoring line at an anchoring line attachment point, at least two non-extensible and parallel links connecting said anchoring line connection member to said buoy, said links having equal length from their point of attachment to said anchoring line connection member to their point of attachment to said buoy, the mutual configuration in space of (a) said points of attachment to said anchoring line connection member and (b) said points of attachment to said buoy, being identical, and wherein the point of impact of the anchoring line force, taken with respect to the points of attachment of the links to the buoy, is fixed and located in the same position as is the anchoring line attachment point, taken with respect to the points of attachment of the links to the anchoring line connection member, said point of impact of the anchoring line force being located inside a body part of said buoy and coinciding with the centre of gravity of said buoy, said anchoring line and said links being connected to said anchoring line connection member and said buoy such that said line and said links are free to extend from said anchoring line connection member and said buoy in all directions having an vertical component.

4. An anchoring system for a buoy, said buoy being adapted to follow the wave slopes of a water surface in which it floats and which is equipped to detect and measure its own orientation with respect to the vertical, having an anchoring line connection member connected to an anchoring line at an anchoring line attachment point, at least two non-extensible and parallel links connecting said anchoring line connection member to said buoy, said links having equal length from their point of attachment to said anchoring line connection member to their point of attachment to said buoy, the mutual configuration in space of (a) said points of attachment to said anchoring line connection member and (b) said points of attachment to said buoy, being identical, and wherein the point of impact of the anchoring line force, taken with respect to the points of attachments of the links to the buoy, is located fixed and in the same position as is the anchoring line attachment point, taken with respect to the points of attachment of the links to the anchoring line connection member, said point of impact of the anchoring line force being located inside a body part of said buoy, and coinciding with the centre of gravity of said buoy and with the centre of gravity of the water displaced by said buoy and being located at the level of the work point of the reaction force cuased by relative horizontal movement of the buoy with respect to the water.

5. An anchoring system for a buoy, said buoy being adapted to follow the wave slopes of a water surface in which it floats and which is equipped to detect and measure its own orientation with respect to the vertical, having an anchoring line connection member connected to an anchoring line at an anchoring line attachment point, at least two non-extensible flexible and parallel links connecting said anchoring line connection member to said buoy, said links having equal length from their point of attachment to said anchoring line connection member to their point of attachment to said buoy, the mutual configuration in space of (a) said point of attachment to said anchoring line connection member and (b) said points of attachment to said buoy, being identical, and wherein the point of impact of the anchoring line force, taken with respect to the points of attachment of the links to the buoy, is fixed and located in the same position as is the anchoring line attachment point taken with respect to the points of attachment of the links to the anchoring line connection member, said point of impact of the anchoring line force being located inside a body part of said buoy, and coinciding with the centre of gravity of said buoy, said anchoring line and said links being connected to said anchoring line connection member and said buoy.

6. An anchoring system for a buoy, said buoy being adapted to follow the wave slopes of a water surface in which it floats and which is equipped to detect and measure its own orientation with respect to the vertical, having an anchoring line connection member connected to an anchoring line at an anchoring line attachment point, at least two non-extensible flexible and parallel links connecting said anchoring line connection member to said buoy, said links having equal length from point of attachment to said anchoring line connection member to their point of attachment to said buoy, the mutual configuration in space of (a) said points of attachment to said anchoring line connection member and (b) said points of attachment to said buoy, being identical, and wherein the point of impact of the anchoring line force, taken with respect to the points of attachment of the links to the buoy, is fixed and located in the same position as is the anchoring line attachment point taken with respect to the points of attachment of the links to the anchoring line connection member, said point of impact of the anchoring line force being located inside a body part of said buoy, and coinciding with the centre of gravity of said buoy, said anchoring line and said links being connected to said anchoring line connection member and said buoy, said points of attachment of said links to said buoy being located at a horizontal lower surface part of said buoy inward from the outer circumference of said buoy.

7. An anchoring system for a buoy, said buoy being adapted to follow the wave slopes of a water surface in which it floats and which is equipped to detect and measure its own orientation with respect to the vertical, having an anchoring line connection member connected to an anchoring line at an anchoring line attachment point, four non-extensible flexible and parallel links connecting said anchoring line connection member to said buoy, said links having equal length from their point of attachment to said anchoring line connection member to their point of attachment to said buoy, the mutual configuration in space of (a) said points of attachment to said anchoring line connection member and (b) said points of attachment to said buoy, being identical and wherein the point of impact of the anchoring line force, taken with respect to the points of attachment of the links to the buoy, is fixed and located in the same position as is the anchoring line attachment point, taken with respect to the points of attachment of the links to the anchoring line connection member, said point of impact of the anchoring line force being located inside a body part of said buoy, and coinciding with the centre of gravity of said buoy, said anchoring line and said links being connected to said anchoring line connection member and said buoy, said buoy having a disc shaped body part with a horizontal lower surface and in the centre of the disc shaped body part and protruding downwardly from it a closed member, said points of attachment being located at said lower surface between its outer edge and the said protrusion, the anchoring line connection member having a central connection to the anchoring line and four attachment points for the links, said four points being the corners of a square and the anchoring line attachment point being located in a line perpendicular to the plane of said square in the centre of said square, the outer wall surface of said disc tilting downwardly and inwardly.

8. An anchoring system for a buoy as claimed in claim 7 wherein the length of each of said links is less than the diameter of the buoy.

* * * * *